US005564244A

United States Patent [19]

Bidaux

[11] Patent Number: 5,564,244

[45] Date of Patent: Oct. 15, 1996

[54] DEVICE FOR THE INJECTION AND RETENTION OF A TREATMENT PRODUCT IN A MASONRY STRUCTURE

[76] Inventor: Marc Bidaux, 14, rue Ehlinger, 90400 Andelnans, France

[21] Appl. No.: 146,318

[22] Filed: Nov. 2, 1993

[30] Foreign Application Priority Data

Dec. 9, 1992 [FR] France ..... 92 14998

[51] Int. Cl.[6] ..... E04C 5/12; F16B 13/04

[52] U.S. Cl. ..... 52/514.5; 52/698; 52/704; 41/72

[58] Field of Search ..... 52/514.5, 741.4, 52/744, 745.21, 698, 737, 739, 740, 742.15, 742.14, 742.13; 405/266, 269; 411/72, 73, 74

[56] References Cited

U.S. PATENT DOCUMENTS

| | | | |
|---|---|---|---|
| 1,971,726 | 8/1934 | Norwood | 52/698 |
| 3,298,144 | 1/1967 | Fischer | 52/742.15 |
| 3,548,554 | 12/1970 | Spanel | 52/514.5 |
| 4,103,498 | 8/1978 | Steinborn et al. | 52/742.15 |
| 4,840,523 | 6/1989 | Oshida | 411/72 |
| 5,079,881 | 1/1992 | Haage et al. | 52/514.5 |
| 5,145,301 | 9/1992 | Yamamoto | 411/72 |
| 5,366,672 | 11/1994 | Alberigo et al. | 52/742.15 |

FOREIGN PATENT DOCUMENTS

| | | | |
|---|---|---|---|
| 2589920 | 4/1987 | France | 411/73 |
| 455280 | 10/1936 | United Kingdom | 411/72 |
| 2137273 | 10/1984 | United Kingdom | 52/698 |

*Primary Examiner*—Michael Safavi

[57] ABSTRACT

Peg-type device for the injection and retention of a treatment product in a masonry wall, of the type consisting of an elongated hollow body [1] in the shape of a slightly tapered, truncated cone, that is fitted at its rearward extremity with a splayed or flared portion in the shape of a truncated cone [10] and is fitted along its entire length with a series of flanges.

Said elongated hollow body [1] includes in its rearward portion [11] a series of regularly spaced circular flanges [2] having a diameter that is larger than the diameter of the orifice into which the device is to be introduced, with the exception of the flange [20] located at the extremity that has a diameter smaller than the diameters of the other flanges, but still slightly larger than that of said orifice; and said device includes in its forward portion [12] a series of flanges [3 ] [4], that are either oblong in shape or shaped approximately like a cross with wide arms, with every other flange in said last series including, around the edge of its forward surface, at least two essentially hemi-ellipsoidal beads or enlargements [43] that are positioned diametrically opposite one another.

5 Claims, 3 Drawing Sheets

DEVICE FOR THE INJECTION AND RETENTION OF A TREATMENT PRODUCT IN A MASONRY STRUCTURE

The present invention concerns a peg-type device for the injection and retention of a treatment product in a masonry wall, and more particularly a means that permits anchoring and tightness of said device.

Peg-type injection devices are already known which are seated by force within orifices formed in the material to be treated—e.g., wood, concrete, or some other material—in order to allow the injection, under pressure, of a treatment product, with said peg-type devices including an internal anti-return device, such as a valve, for the retention of said product.

However, fairly often such devices display defects in terms of tightness, in such a way as to allow the treatment product to pass between said peg-type device and the wall of the orifice into which said device has been introduced.

Such existing devices generally include along their entire length a series of regularly spaced circular flanges having a diameter that is slightly larger than the diameter of the orifice into which the device is to be introduced, in order to permit the anchoring of the device. However, when the peg-type device is introduced into the orifice, said flanges are deformed and, owing to their larger circumference, undulate around their periphery, thereby degrading the tightness and the security of the anchoring.

On the other hand, said flanges have a certain degree of thickness, and their edges are rounded in such a way that the wall of the orifice into which the device is to be introduced is tangent to said rounded edges, in order to facilitate fastening the device and to ensure the tightness of its insertion. However, the angle at which said flanges are bent varies in accordance with the diameter of the orifice in such a way that the pressure of application is sometimes exerted at an excessively acute angle, thereby degrading the quality of the anchoring.

The goal of the present invention is to remedy these disadvantages by proposing a device that includes a combination of means that make it possible to ensure both the secure fastening of said peg-type injection device within the material to be treated and also a good degree of tightness.

The peg-type injection device that is the object of the present invention and is preferably realized by means of molding of a plastic material includes an elongated hollow body in the shape of a slightly tapered, truncated cone, that is broadly splayed or flared at its rearward extremity, which is intended to receive the injection tool. Said device in accordance with the invention is characterized essentially by the fact that said elongated hollow body is fitted along its entire length with a series of flanges that have different profiles in accordance with their location at the rear of said device, in the area of said flare, or at the forward portion of said device.

In accordance with the invention, said flanges of said rear portion are completely circular and have a diameter that is larger than the diameter of the orifice into which the device is to be introduced with the exception of the flange located at the extremity, which has a diameter that is smaller than the diameters of the other flanges, but that is still slightly larger than that of said orifice, in order to perfect the tightness of the insertion, while at the same time avoiding excessive deformation when said peg-type device is inserted into said orifice.

Likewise in accordance with the invention, the flanges located on the front of said device are not circular but are either oblong in shape or shaped approximately like a cross with wide arms, in such a way as to prevent said flanges from undulating around their periphery when said peg-type device is inserted into said orifice.

Furthermore, every other flange in said front part of said peg-type device includes, around the edge of the front surface, at least two essentially hemi-ellipsoidal beads or enlargements that are arranged diametrically opposite one another, in such a way that when said peg-type device is inserted into an orifice in the wall to be treated and said flange bends, due to the fact that its diameter is larger than that of said orifice, said flange comes into contact with the wall of said orifice at an angle that is more acute than the angle at which conventional flanges come into contact with the wall of an orifice, thereby ensuring an improved anchoring.

In accordance with a first embodiment of the device in accordance with the invention, the flanges located on the front of said devices form an alternating series of flanges that are oblong in shape and are shaped approximately like a cross with wide arms, with each oblong flange including at each of its two extremities an essentially hemi-ellipsoidal bead or enlargement.

In accordance with a second embodiment of the device in accordance with the invention, the flanges located on the front of said device are all shaped approximately like across with wide arms, and every other flange in said front is filled around the edge with at least two and preferably four beads or enlargements of said essentially hemi-ellipsoidal type.

As explained above, said beads or enlargements with which every other flange located on said forward portion of the device in accordance with the invention is fitted to make it possible to ensure an improved degree of contact with said wall of said orifice that has been formed in said masonry work,as a result of the shape and position of said flange, which ensures contact between said wall and a rounded surface at an angle that is more acute than the angle at which conventional flanges come into contact with such walls.

The advantages and characteristics of the present invention will be more clearly understood through the description that appears below and refers to the enclosed drawing, which represents a non-limiting embodiment of tile invention.

Figure 1:
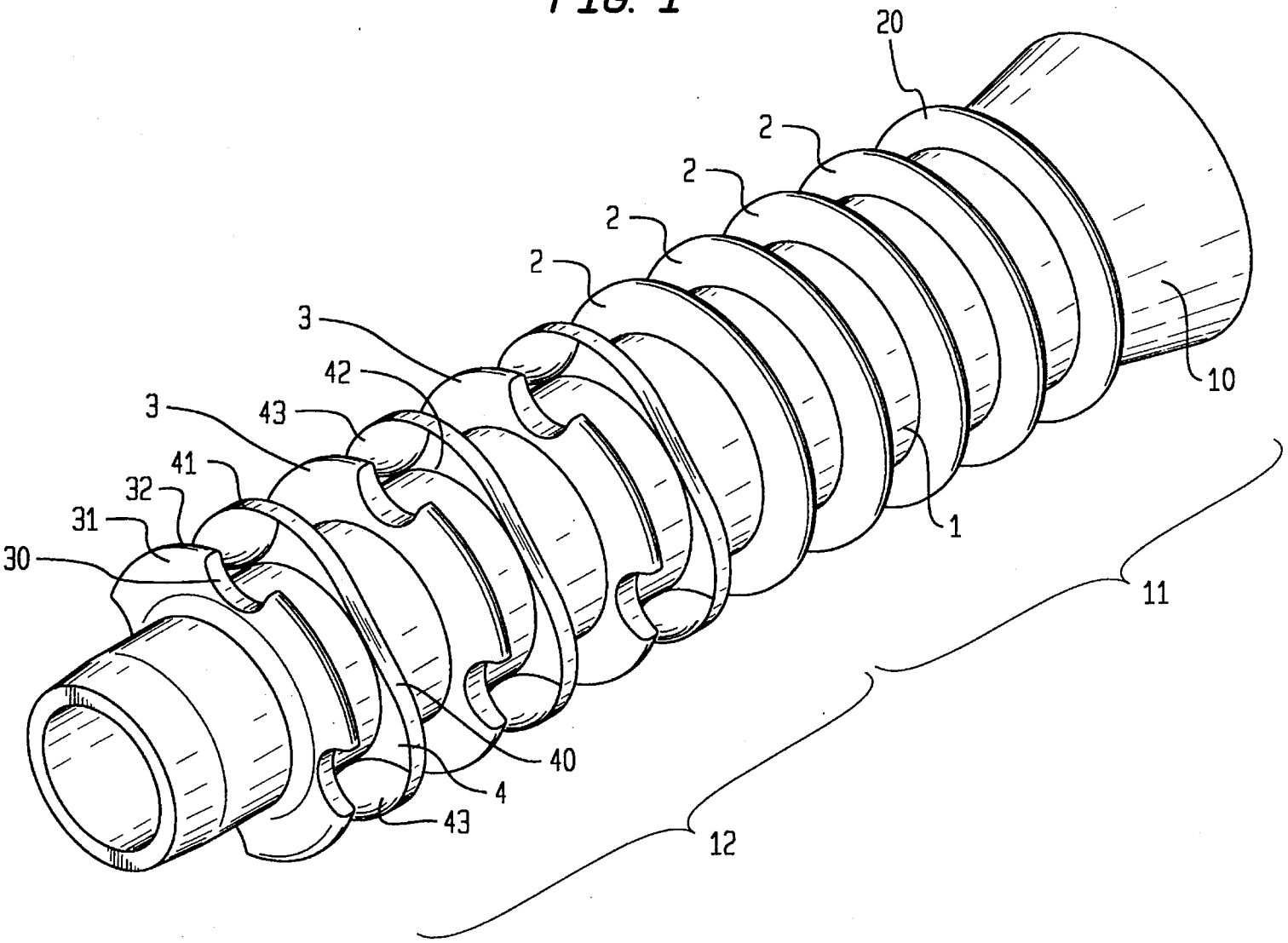
FIG. 1 represents a perspective view of a peg-type injection device in accordance with the invention.
Figure 2:
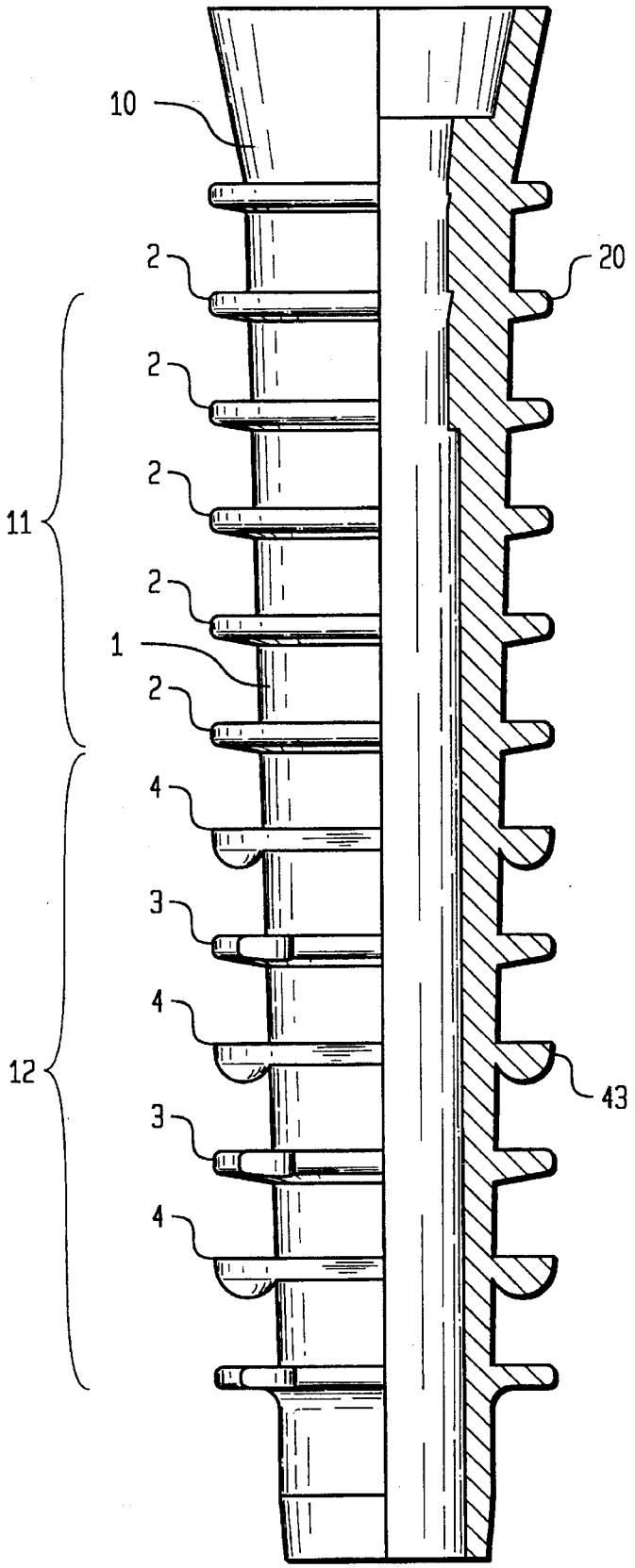
FIG. 2 represents an elevation view, with a partial section of said device.
Figure 3A:
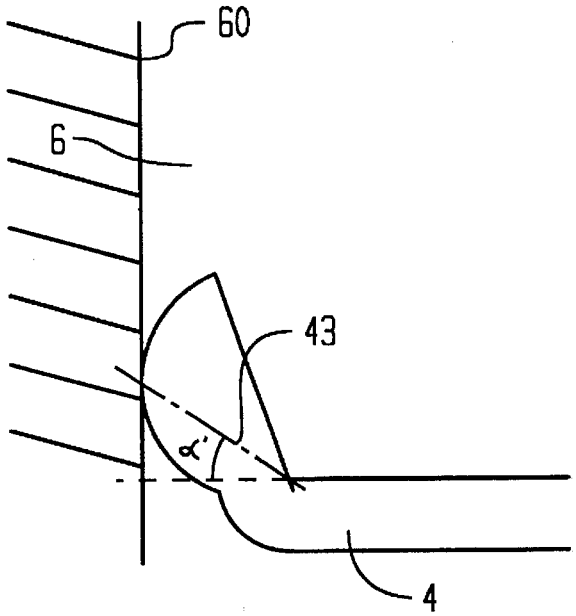
Figure 3B:
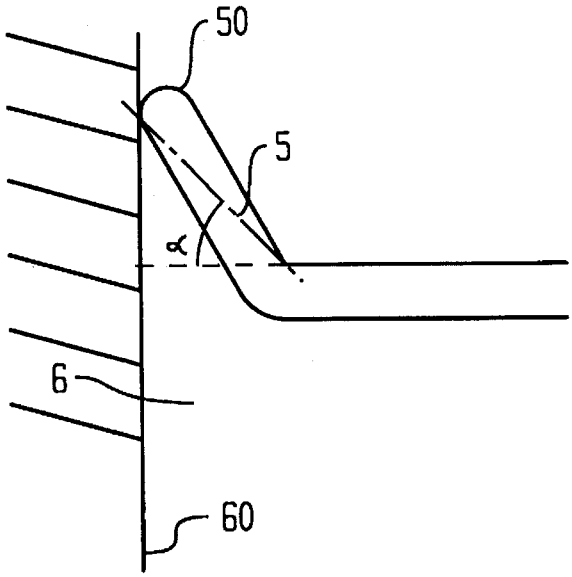

FIG. 3*a* represents a sectional view of a detail of said same device when said device is inserted into an orifice; and FIG. 3*b* represents the same view of a conventional peg-type device;

With reference to FIG. 1 and FIG. 2, it can be seen that a peg-type injection device in accordance with the invention includes an elongated hollow body [1] in the shape of a slightly tapered, truncated cone that is terminated by an splayed or flared portion [10] in the shape of a truncated cone at its rearward extremity, which is intended to receive the injection tool. Said elongated hollow body [1] includes in its rearward portion [11] a series of regularly spaced circular flanges [2] having a diameter that is larger than the diameter of the orifice into which the peg-type injection device is to be introduced, with the exception of the flange [20] that is located closest to said splayed or flared portion [10], that has a diameter smaller than the diameter of the other flanges, but still slightly larger than that of said orifice.

In its forward portion [12] said elongated hollow body [1] includes an alternating series of first flanges [4] that are oblong in shape and second flanges [3] that are shaped approximately like a cross—that is, said flanges [3] we circular and include cut-away portions [30] that delimit arms [31]. In this way, when said peg-type device is introduced into an orifice, the extremity [32] of each of said arms [31] of said flanges [3] is intimately applied against the wall of said orifice and does not undulate, as is the case with the flanges of conventional peg-type devices.

Said flanges [4] that are oblong in shape each include two arms [40] , the extremity of which [41] is in the shape of an arc of a circle whose radius is close to that of the extremity [32] of an arm [31] of said flanges [3].

Each of said arms [40] includes, on its forward surface [42], a bead or enlargement [43] that is essentially hemi-ellipsoidal in shape.

With reference now to FIG. 3*b*, it can be seen that a conventional flange [5], when introduced into an orifice [6] , is bent at a certain angle $\alpha$ against the wall [60] of said orifice. When said angle exceeds a certain limit value, contact with said wall [60] is not made by the rounded extremity [50], thereby degrading the quality of the anchoring.

With reference now to FIG. 3*a*, it can be seen that in the case of a flange [4] of the device in accordance with the invention, due to the presence of said bead or enlargement [43], said wall [60] is always in contact with said bead or enlargement [43], even for an angle $\alpha'$ that is greater than said angle $\alpha$ thereby ensuring an improved anchoring.

The present invention is not limited to the proceeding description of the above discussed embodiments. These embodiments are subject to obvious modifications without departing from the scope of the invention.

I claim:

1. A device for injection and retention of a treatment product in an orifice of a masonry structure comprising:

an elongated substantially hollow body, said body formed with at least rear and front ends as well as an outside surface, a rearward portion positioned adjacent said rear end, a forward portion positioned adjacent said front end, said outside surface having slightly tapered configuration, said rear end formed as a flared truncated cone portion;

said rearward portion having a plurality of spaced substantially circular flanges, each said substantially circular flange having a diameter;

an auxiliary flange situated between said rear end and said rearward portion, an outside periphery of said auxiliary flange being smaller then said diameters of said substantially circular flanges; and said forward portion having a multiplicity of intermixed first and second flanges, each said first flange having an oblong configuration with two diametrically opposed semi-ellipsoidal enlargements, each said second flange having cross-shaped arms.

2. The device of claim 1, wherein at least some of said first and second flanges are formed with round edges on forwardly facing surfaces thereof.

3. The device of claim 1, wherein said device is a peg-type device.

4. The device of claim 1, wherein said each first flange is formed with two opposing arms having arc-shaped exterior portions, said cross-shaped arms of each said second flange is provided with arc-shaped outer parts, said arc-shaped exterior portions of the first flange end said arc-shaped outer parts of said second flange are positioned equadistantly from a longitudinal axis of said elongated substantially hollow body.

5. The device of claim 1, wherein upon insertion of said device into said orifice in the masonry structure said semi-ellipsoidal enlargements of said first flanges are in constant engagement with an interior portion of said orifice.

* * * * *

UNITED STATES PATENT AND TRADEMARK OFFICE

CERTIFICATE OF CORRECTION

PATENT NO. : 5,564,244

DATED : Oct. 15, 1996

INVENTOR(S) : Bidaux

It is certified that error appears in the above-identified patent and that said Letters Patent is hereby corrected as shown below:

On the title page, item [54]:

should read --DEVICE FOR INJECTION AND RETENTION OF A TREATMENT PRODUCT IN A MASONRY STRUCTURE--

On the cover page after Primary Examiner, Michael Safavi, insert --Attorney, Agent, or Firm - Lerner, David, Littenberg, Krumholz & Mentlik--.

Column 1, line 37, "orifice" should read --orifice,--.

Column 2, line 2, '28, "across" should read --a cross--.

Column 2, line 44,"tile" should read--are--

Column 3, line 4, "we" should read --are--.

Signed and Sealed this

Thirty-first Day of December, 1996

*Attest:*

*Attesting Officer*

BRUCE LEHMAN

*Commissioner of Patents and Trademarks*